United States Patent [19]

Imhoff

[11] 3,993,337

[45] Nov. 23, 1976

[54] AUTOMATIC SURFACE BOLT

[75] Inventor: William B. Imhoff, Springdale, Conn.

[73] Assignee: Leigh Products, Inc., Coopersville, Mich.

[22] Filed: Sept. 15, 1975

[21] Appl. No.: 613,177

[52] U.S. Cl. ..... 292/332

[51] Int. Cl.[2] ..... E05C 1/14

[58] Field of Search ..... 292/332, 333, 334, 335, 292/336, 262

[56] References Cited

UNITED STATES PATENTS

| | | | |
|---|---|---|---|
| 1,071,656 | 8/1913 | Voight | 292/333 |
| 1,674,760 | 6/1928 | Carroll | 292/333 X |
| 3,894,356 | 7/1975 | Amhoff | 292/262 |

*Primary Examiner*—Richard E. Moore

*Attorney, Agent, or Firm*—DeLio and Montgomery

[57] ABSTRACT

An automatic surface bolt for doors swinging in pairs having a stop to hold the active door open until the inactive door is closed and a top bolt which is actuated by movement of the stop to lock the inactive door as the active door completes its closing movement, the inactive door having also a bottom bolt arranged to be actuated by the top bolt so that the door is bolted top and bottom when both doors are closed; both bolts holding the inactive door are automatically released when the active door is opened.

16 Claims, 7 Drawing Figures

AUTOMATIC SURFACE BOLT

This invention relates to an automatic surface bolt mechanism having a movable stop to hold the active door open until the inactive door is closed.

The present invention is primarily for use on doors swinging in pairs without overlapping edges, astragals or rabbetted edges. When used on pairs of doors with overlapping edges, astragals or rabbetted edges, a supplementary coordinator is required to hold the active door open far enough so that the inactive door can close without interference.

Door closing control mechanisms or coordinators having a door-holding element and a spaced triggering device, mechanically connected to cause the desired sequence of door closing, are known in general. The combination of a coordinator with one or more automatically actuated bolts has added advantages over such known devices. With this combination, the active door may, if desired, be provided with a key-operated lock or the like (not shown) of any suitable type so that both doors can be locked and unlocked by the manipulation only of the locking means so provided in the active door. This mechanism takes the place of a panic bar which might otherwise be installed on the inactive door.

Briefly stated, the invention in one form thereof comprises a mechanism mounted on the head frame of a double door which determines the order of closing of the doors and further locks one of the doors. A bolt is adapted to move downwardly from the mechanism to engage the inactive door only after the inactive and the active doors are closed, in that order. The active door is held in a partially open position until the inactive door is closed. Then the holding means for the active door is released and the active door closes, actuating the bolt. The active door must be first opened to release the bolt holding the inactive door.

It is an object of the invention to provide a pair of doors with bolting and coordination including a bolt which is movable to engage the inactive door in response to the retraction of a movable stop when it is contacted by the active door.

It is a further object of the invention to provide a pair of doors with bolting and coordination including a top bolt which is movable to engage the inactive door and a bottom bolt which is actuated by the top bolt.

It is yet another object of the invention to provide certain improvements in the form, construction and arrangement of the several parts whereby the above-named and other objects may effectively be attained.

The features of the invention which are believed to be novel are particularly pointed out and distinctly claimed in the concluding portion of this specification. However, the invention both as to its organization and operation, together with further objects and advantages thereof, may best be appreciated by reference to the following detailed description taken in conjunction with the drawings, wherein:

Figure 1:
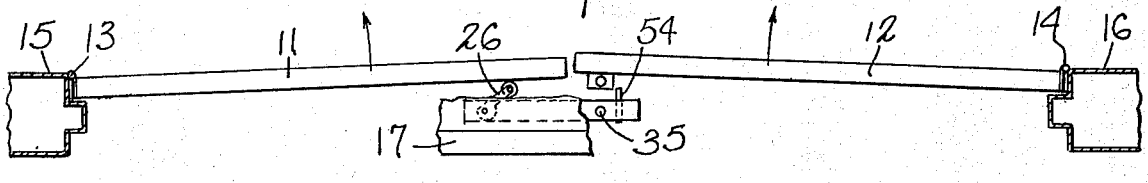
FIG. 1 is a somewhat diagrammatic horizontal section across the top of the doors, parts of the head frame being broken away and the doors being shown in nearly closed position.

Referring to the drawings, the apparatus is shown as being applied to a pair of swinging doors comprising an active door 11 and an inactive door 12, hung at 13, 14 in a frame having jambs 15, 16 and a head frame 17. The head frame is shown as being a channel or shape having a lintel portion 18 and a stop portion 19.

The mechanism includes a lower housing 21, fixed to the bottom of the stop portion 19 of the frame by screws or bolts 22, and an upper housing 23, mounted on the lower housing and projecting through an opening 24 in said stop portion, the upper housing having an upper wall 25.

Figures 5, 6, 7:
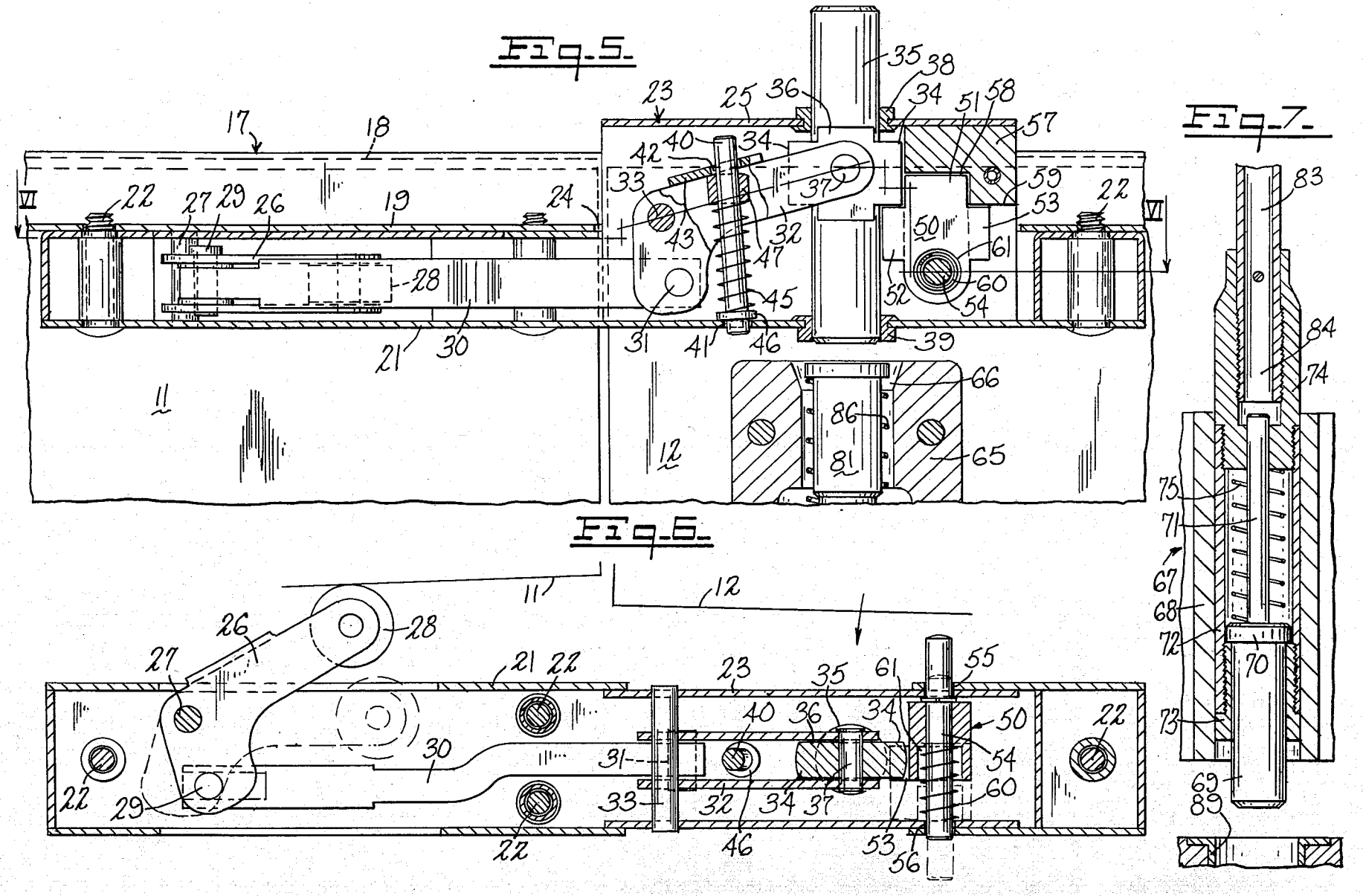
FIG. 5 is a vertical section on line V—V of FIG. 4.
FIG. 6 is a horizontal section on the line VI—VI of FIG. 5.
FIG. 7 is a vertical section on the line VII—VII of FIG. 3.

The active door control comprises the drive link 26 in the form of a pair of parallel bell cranks pivoted at 27 in the lower housing and having a roller 28 on their free ends, the inner ends being connected by a pin 29 to one end of a connecting rod 30. The opposite end of the rod 30 is connected by a pin 31 to one end of the bolt link 32 (also in the form of a pair of parallel bell cranks) which is pivoted at 33 in the side walls of the upper housing. The upper bolt 35 is cylindrical with a medial flattened portion 36 and laterally projecting bosses 34, the ends of the link 32 being pivotally connected by a pin 37 to bear on opposite sides of the flat portion 36. The bolt is journaled in bushings 38, 39 in the upper wall 25 of the housing and the bottom of the lower housing, respectively. A spring guide 40 has its lower end supported loosely in the hole 41 in the bottom wall of housing 21 while its upper end passes loosely through an opening 42 in a plate 43 fixed to the upper edges of the link 32. A spring 45, under compression, is mounted on the guide between a washer 46 at the bottom and a sliding collar 47 which bears against the bottom of the plate 43, thus biasing the link 32 toward its bolt release position, as shown in FIG. 5.

A bolt holding slide 50 having a head portion 51 and laterally projecting shoulders 52, 53 is fixed on the plunger 54 which slides horizontally in openings 55, 56 through the housing walls. The upper housing is provided with a guide block 57 having surfaces 58, 59 complementary to those of the head 51 and shoulder 53 of the lock, to prevent rotation thereof around the axis of the plunger. The opposite shoulder 52 is adjacent to the bolt and is adapted to fit closely beneath the boss 34 on the bolt when the plunger is in its advanced position (FIG. 6) protruding toward the inactive door. A spring 60 on the plunger bears against the housing wall and extends into a recess 61 in the bolt holding slide, biasing the plunger toward its advanced position.

The inactive door is provided with a top strike 65, screwed or bolted onto the face of the door near its upper edge and having an opening 66 adapted to receive the lower end of the upper bolt 35. While it may, under some conditions, be deemed sufficient to lock the door 11 only at the top, it is generally preferable to provide both top and bottom bolts, as shown herein. The bottom bolt 67 is mounted in a support 68 near the bottom of the door and comprises the cylindrical body portion 69, head 70 and guide spindle 71, all carried in an assembly which includes the bolt tube 72, bushing 73 screwed into the bottom of the tube, adjuster 74 screwed into the top of the tube and spring 75 between the bottom of the adjuster and head of the bolt. The bolt body 69 slides in the bushing 73 and the splindle 71 slides in the bore 76 in the bottom of the adjuster.

Figure 4:
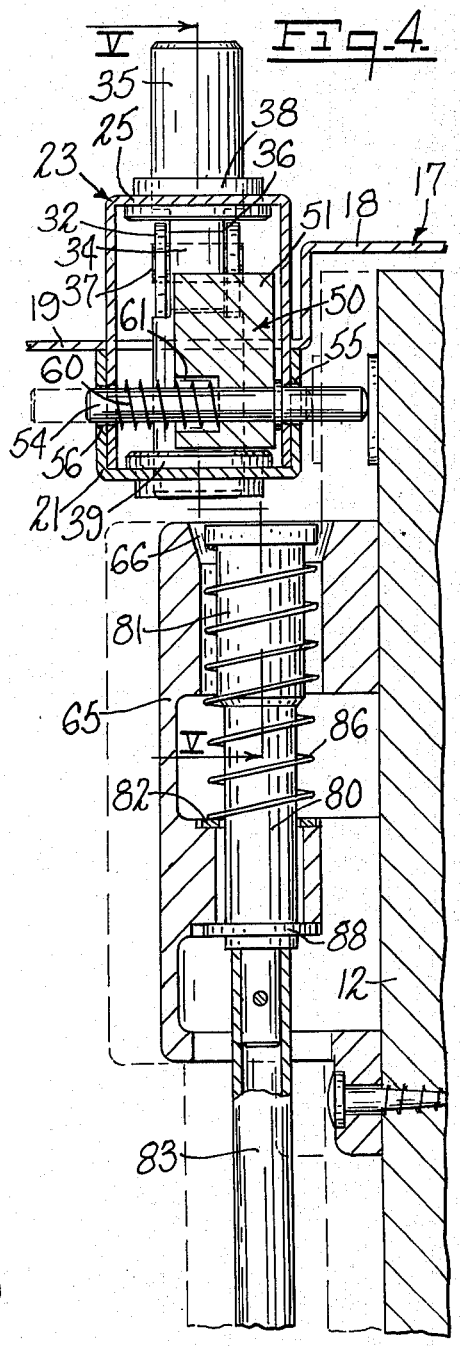
FIG. 4 is a vertical section on line IV—IV of FIG. 2.

The bottom bolt is arranged to be actuated by the top bolt through a drive assembly which includes a rod having a cylindrical top 80 with a head portion 81 supported in a nylon bushing 82 in the top strike 65 and a length of tubing 83 fixed to the top 80 and having its lower end 84 screwed into the top of the adjuster 74, the tube passing through a plurality of guides 85 attached to the face of the door at suitable intervals. The assembly is held resiliently in its top position (FIG. 4) by means of a spring 86 between the bushing 82 and the flange 87 at the top of the head, upward movement being limited by the retaining ring 88. The threaded connection between the tube and the adjuster permits accurate adjustment of the throw of the bolt. When advanced into locking position the bottom bolt is received in a strike 89 set into the floor in an appropriate position, the strike being preferably of the dust proof type to minimize clogging.

In operation, when both doors are open or ajar, at least as far as indicated in FIG. 1, the mechanisms will be at rest in the position shown in full lines in FIGS. 4, 5, 6 and 7. Moving the inactive door 12 to its fully closed position will push in the plunger 54, moving the shoulder 52 to the retracted position shown in broken lines in FIG. 6; in this condition the top bolt 35 is free to be moved down into bolting position but is held in open position by the spring 45. So long as the inactive door 12 is ajar the active door 11 cannot be closed, because the bolt holding slide 50 prevents the bolt 35 from moving and the linkage from the bolt to the drive link 26 maintains the latter in its projecting position, FIGS. 1 and 6.

Figure 2:
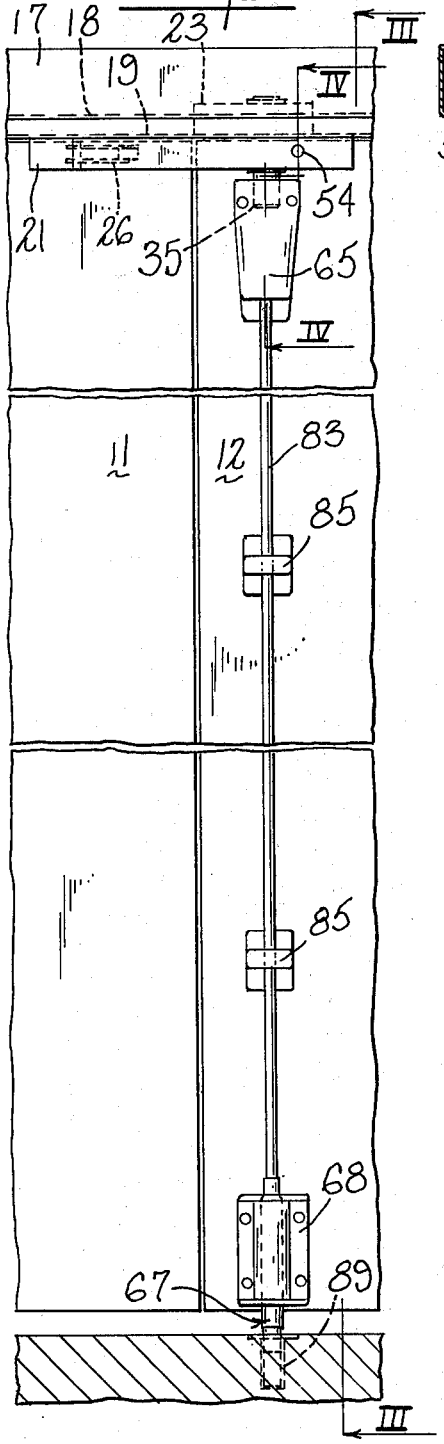
FIG. 2 is an elevation of the free edge portions of the doors in closed position, parts being broken away and the floor being in section.
Figure 3:
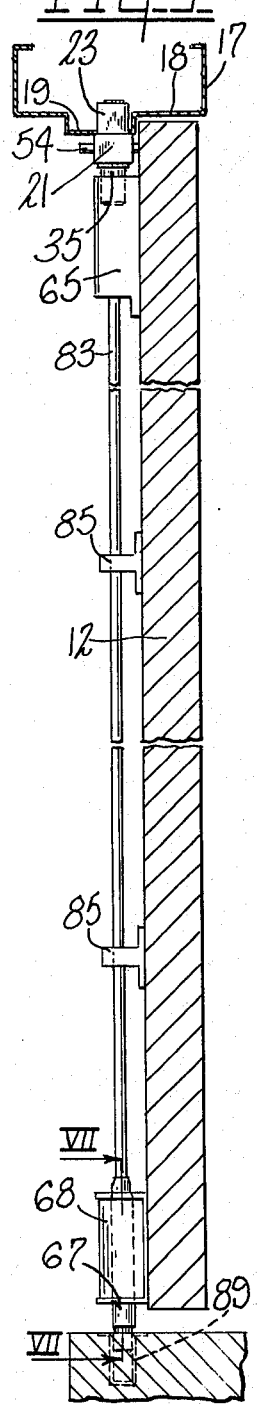
FIG. 3 is a vertical section on the line III—III of FIG. 2.

Assuming the inactive door 12 to have been fully closed, thus freeing the bolt as explained above, locking is effected, automatically, by fully closing the active door 11. This rotates the drive link 26 about its pivot 27, draws the rod 30 toward the left (FIGS. 5 and 6), rotates the bolt link 32 about its pivot 33, and slides the bolt 35 downward to its projected position (FIGS. 2 and 3). If the door is equipped with a bottom bolt, the top bolt 35 strikes the head 81 of the bolt drive assembly, compressing the spring 86 and pushing downward the parts 81, 80, 83, 74, and 72, which carry with them the bottom bolt 69. The bolt should, if properly in register, engage in the strike 89; if the bolt and strike are not correctly aligned for any reason, so that the bolt comes in contact with the floor, the spring 75 will be compressed and the door will be locked by the top bolt alone without strain or damage to the parts.

If the active door is equipped with a lock or bolt, as suggested above, it may be actuated to secure both doors in the closed position. When the doors are closed and the active door is unlocked (or has no lock) both doors can be opened almost simultaneously by moving the active door far enough to release the drive link (e.g., to the position shown in FIG. 1) which automatically retracts the top bolt 35 and permits the bottom bolt 69 to be withdrawn by the spring 86. The inactive door, thus unbolted, need move only a slight distance to permit the plunger 54 to advance and carry the bolt holding slide 50 to its blocking position.

In the train of elements controlling the actuation of the bolts, both of the springs 45 and 86 are biased to release the respective bolts from their strikes; the bolts must be mechanically moved against that bias to become engaged in closed position, and they are automatically released when the mechanical forces are removed. This is an important safety factor since the active door can be opened instantly with no thought beyond the instinctive one of pushing against it, thus permitting the bolt or bolts holding the inactive door to retract. The bolt holding slide 50 retains the bolt in unlocked position until the doors are intentionally closed.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

What I claim is:

1. A surface bolt mechanism for an active door and an inactive door hung to swing as a pair in a door frame comprising a movable stopping element adapted to be mounted on the door frame in a position to be contacted and moved by the active door, a bolt adapted to be slidably mounted in a position to engage the top of the inactive door, and mechanical means connecting the stopping element to the bolt such that movement of the stopping element actuates the mechanical means to move the bolt.

2. A surface bolt according to claim 1 which includes a blocking element supported for movement into and out of engagement with the bolt for preventing or permitting movement of the bolt.

3. A surface bolt according to claim 2 which includes means associated with the blocking element and projecting into the path of the inactive door, such that closing of the inactive door moves the blocking element out of engagement with the bolt.

4. A surface bolt according to claim 3 wherein the means associated with the blocking element is a plunger having one end slidable horizontally into the path of the inactive door.

5. A surface bolt according to claim 1 wherein the stopping element comprises one leg of a bell crank, the mechanical means comprises a connecting rod pivoted at one end to the second leg of said bell crank and a second bell crank connecting the other end of said rod to said bolt.

6. A surface bolt mechanism for an active door and an inactive door hung to swing as a pair in a door frame comprising a housing adapted to be fixed to said frame, a movable stopping element mounted in said housing and movable into and out of the path of the active door, a bolt slidably mounted in the housing for engagement with the inactive door and mechanical means in the housing for connecting the stopping element to the bolt such that movement of the stopping element actuates the mechanical means to move the bolt.

7. A surface bolt according to claim 6 which includes a blocking element supported in the housing for horizontal movement into and out of engagement with the bolt.

8. A surface bolt according to claim 7 which includes a plunger fixed to the blocking element and slidable horizontally in the housing, and means biasing said plunger to a position such that one end of the plunger projects into the path of the inactive door.

9. A surface bolt according to claim 1 which includes a second bolt mounted adjacent the bottom of said inactive door, and actuating means for said second bolt on said inactive door, said actuating means including an element adapted to be engaged and moved by the first named bolt.

10. A surface bolt according to claim 9 which includes a strike in the floor to receive said second bolt, and wherein said second bolt is mounted resiliently in said actuating means to permit relative movement of said second bolt and said actuating means if the bolt fails to enter the strike.

11. A surface bolt mechanism for a pair of doors hung in a doorway which includes a head frame, comprising a housing member adapted to be mounted to the head frame, a bolt in said housing adapted to be moved downwardly into engagement with a strike on one of said doors, movable blocking means for preventing downward motion of said bolt extending from said housing and engageable by said one of said doors, an arm pivotally mounted in said housing and extending therefrom arranged to be engaged by the other of said doors, linkage means extending between said arm and said bolt whereby as said other of said doors engages said arm said linkage means attempts to drive said bolt downwardly, said movable blocking means preventing downward motion of said bolt and movement of said arm until said one of said doors closes and moves said blocking means to permit downward movement of said bolt.

12. The mechanism of claim 11 further including biasing means urging said bolt upwardly from engagement with the strike.

13. The mechanism of claim 11 wherein said arm is pivotally mounted in said housing, said linkage means comprises a link pivotal to said arm, a lever pivotally mounted in said housing and pivotally connected to said bolt and said link, and having means acting on said linkage to maintain said arm extended.

14. The mechanism of claim 11 which includes a plunger fixed to said blocking means and slidable horizontally in the housing, and means biasing said plunger to a position such that one end of the plunger projects into the path of said one door.

15. The mechanism of claim 11 which includes a second bolt mounted adjacent the bottom of said one door, and actuating means for said second bolt on said one door, said actuating means including an element adapted to be engaged and moved by the first named bolt.

16. The mechanism of claim 15 which includes a strike in the floor to receive said second bolt, and wherein said second bolt is mounted resiliently in said actuating means to permit relative movement of said second bolt and said actuating means if the bolt fails to enter the strike.

* * * * *